United States Patent [19]

Pritchard

[11] 4,203,039

[45] May 13, 1980

[54] VEHICLE SLIDING DOOR POWER DOOR LOCK MECHANISM ACTUATING DEVICE CONTROL SYSTEM

[75] Inventor: Gary E. Pritchard, Sterling Heights, Mich.

[73] Assignee: General Motors Corporation, Detroit, Mich.

[21] Appl. No.: 934,622

[22] Filed: Aug. 17, 1978

[51] Int. Cl.[2] ..... E05B 65/36

[52] U.S. Cl. ..... 307/10 R; 361/160; 70/279

[58] Field of Search ..... 70/264, 279, 280; 361/139, 160; 307/9, 10 R, 10 AT; 180/111-113; 293/DIG. 3

[56] References Cited

U.S. PATENT DOCUMENTS

| | | | |
|---|---|---|---|
| 3,786,276 | 1/1974 | Rosch | 307/208 |
| 4,001,611 | 1/1977 | Maruyama et al. | 307/293 |

*Primary Examiner*—Harry E. Moose, Jr.
*Attorney, Agent, or Firm*—Richard G. Stahr

[57] ABSTRACT

A vehicle sliding door power door lock mechanism actuating device control system having a memory feature for use with power door lock mechanisms of the type actuated by an electrically energizable actuating device to the "Lock" and "Unlock" conditions in response to respective "Lock" and "Unlock" command signals. The system is operative to effect the electrical energization of the lock mechanism actuating device in a direction to actuate the lock mechanism to the "Lock" condition upon each closure of the sliding door subsequent to an occurrence of a "Lock" command signal while the door is open.

4 Claims, 3 Drawing Figures

VEHICLE SLIDING DOOR POWER DOOR LOCK MECHANISM ACTUATING DEVICE CONTROL SYSTEM

Figure 1:
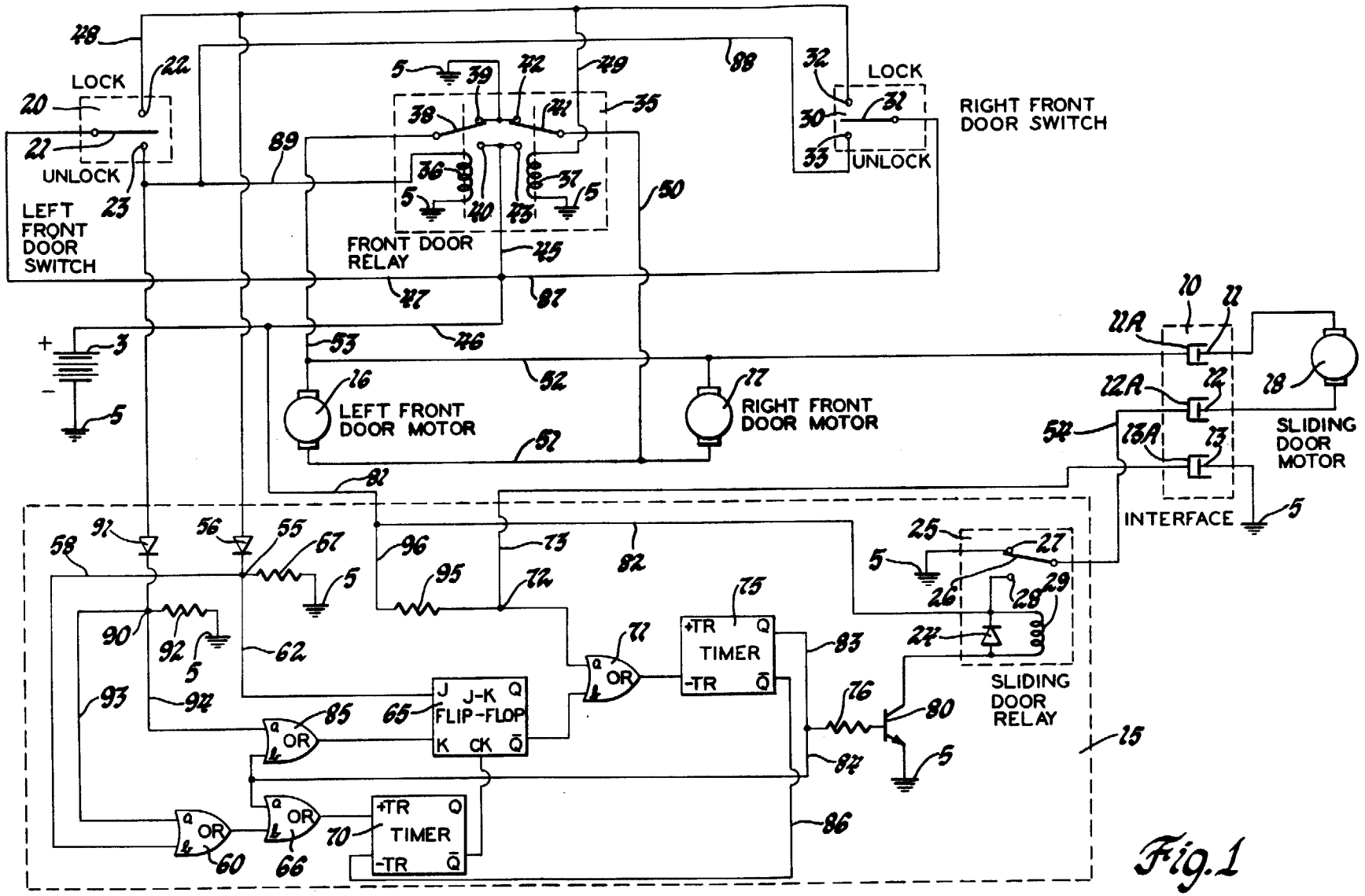

This invention relates to vehicle power door lock mechanism actuating device control systems and, more specifically, to a control system of this type for use with vehicle sliding doors.

As is well known in the automotive art, passenger car doors have been of the rotating type with fixed hinging. With doors of this type, electrical power may be supplied to electrically energizable power door lock actuating devices through permanent "straight through" electrical leads between the vehicle body and the door. Recently, increasing numbers of passenger vehicles are being provided with sliding doors. Doors of this type present unique problems with regard to power door lock systems for the reason that the use of permanent "straight through" electrical leads between the vehicle body and the sliding door is precluded because of the door opening and closing travel distance. One method of solving the problem of providing an electrical circuit between the vehicle body and a sliding door is the provision of a body to sliding door interface electrically engageable and disengageable electrical connector assembly that establishes and interrupts electrical continuity between the body and the sliding door when the sliding door is closed and opened, respectively. As an interface electrical connector assembly of this type provides an electrical connection between the body wiring and the leads through which electrical power is supplied to the power door lock actuating device while the sliding door is closed, the power door lock system operates in a conventional manner when the sliding door is closed. However, as the electrical continuity between the vehicle body and a sliding door is interrupted by an interface electrical connector assembly of this type while the door is open, the power door lock actuating device thereof is disconnected from the electrical power source. As a consequence, should the power door lock system be activated to the "Lock" mode while the sliding door is open, this door does not lock. Therefore, after the sliding door is closed, it must be locked mechanically by hand or the power door lock system must again be activated to the "Lock" mode. The provision of a sliding door power door lock mechanism actuating device control system that provides for the automatic energization of a sliding door power door lock actuating device upon the closure of the door after the power door lock system has been activated to the "Lock" mode while the door is open, therefore, is desirable.

It is, therefore, an object of this invention to provide an improved vehicle sliding door power door lock mechanism actuating device control system.

It is another object of this invention to provide an improved vehicle sliding door power door lock mechanism actuating device control system having a memory feature which provides for the automatic locking of the sliding door upon each closure thereof subsequent to the activation of the power door lock control system to the "Lock" mode while the door is open.

In accordance with this invention, a vehicle sliding door power door lock mechanism actuating device control system is provided wherein a memory feature is operative to effect the electrical energization of the lock mechanism actuating device in a direction to actuate the lock mechanism to the "Lock" condition upon each closure of the sliding door subsequent to an activation of the door lock mechanism control system to the "Lock" mode while the sliding door is open.

Figure 2:
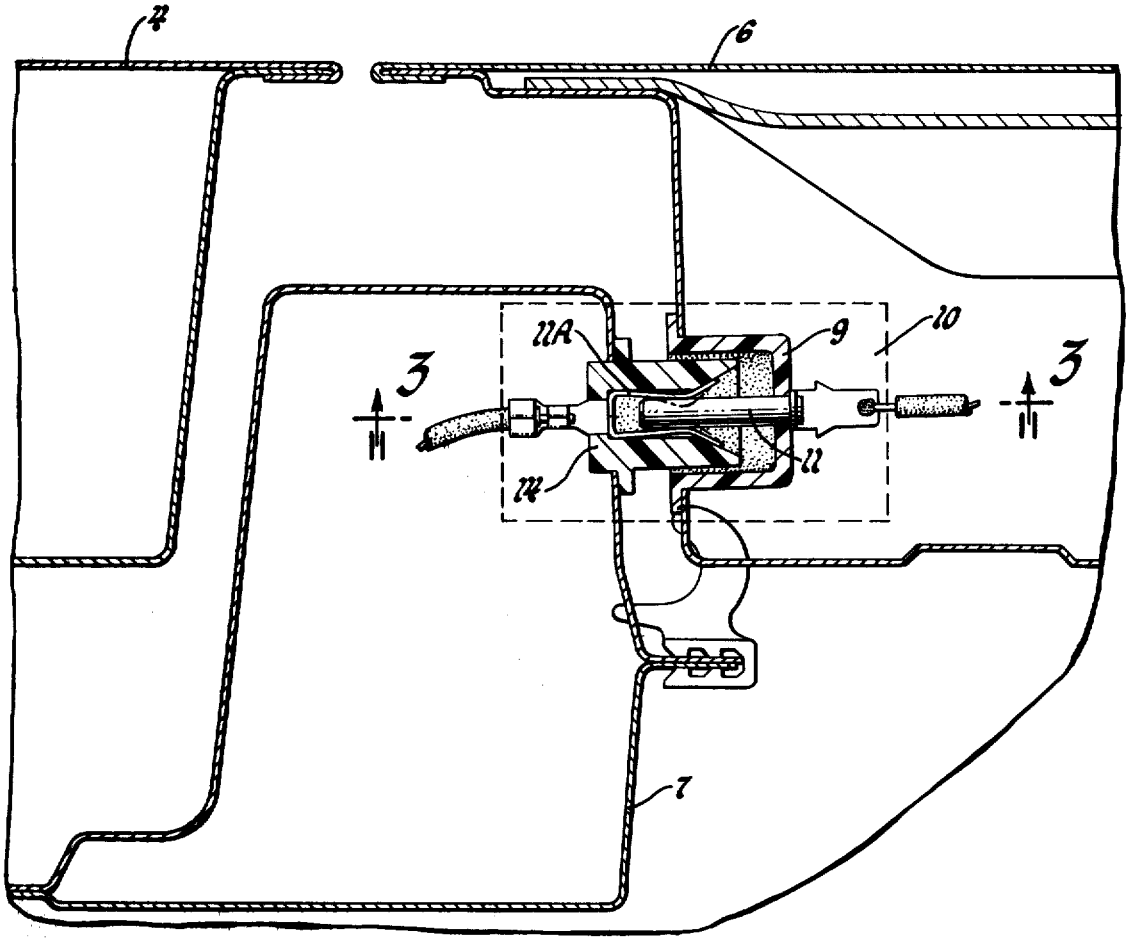
Figure 3:
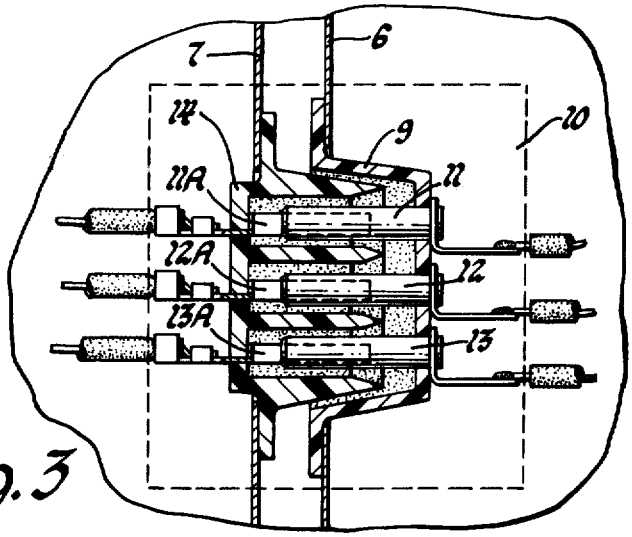

For a better understanding of the present invention, together with additional objects, advantages and features thereof, reference is made to the following description and accompanying drawing in which:

FIG. 1 sets forth the vehicle sliding door power door lock mechanism actuating device control system of this invention in schematic form;

FIG. 2 is a cross-sectional view of a vehicle body to sliding door interface electrical connector assembly suitable for use with the system of this invention; and FIG. 3 is a sectional view of FIG. 2 taken along line 3—3 and looking in the direction of the arrows.

As point of reference or ground potential is the same point electrically throughout the system, it has been illustrated in FIG. 1 of the drawing by the accepted schematic symbol and referenced by the numeral 5.

The circuit of this invention employs four conventional OR gates, two timer circuits and a conventional J-K flip-flop circuit. In an actual embodiment, these devices are commercially available OR gates, monostable multivibrator circuits and a J-K flip-flop circuit marketed by RCA Corporation under the designations CD 4071, CD 4098 and CD 4027, respectively. As a consequence, the circuit elements are illustrated in FIG. 1 in block form. The CD 4098 dual monostable multivibrator provides retriggerable one-shot operation for any fixed timing application and is capable of leading edge triggering (+TR) and trailing edge triggering (−TR) whereby the device may be triggered from either edge of an input pulse and an external resistor and capacitor combination controls the timing of the circuit to provide an output pulse width of a selected duration. The CD 4027 J-K flip-flop circuit is of the type that changes state in synchronism with the positive-going transition of an input "C-lock" pulse.

In the interest of reducing the complexity of FIG. 1 of the drawing, a specific operating potential supply for the OR gates, the timer circuits and the J-K flip-flop circuit has not been shown. It is to be understood, however, that all of these devices have applied thereto rated operating potential.

In accordance with logic terminology well known in the art, throughout this specification logic signals will be referred to as being in the "High" or logic 1 state or in the "Low" or logic 0 state. For purpose of this specification, and without intention or inference of a limitation thereto, the "High" or logic 1 signals will be considered to be of a positive polarity potential and the "Low" or logic 0 signals will be considered to be of zero ground potential.

One example of a power door lock mechanism with which the vehicle sliding door power door lock mechanism actuating device control system of this invention may be used is disclosed and described in U.S. Pat. No. 3,954,016, Sarosy et al, May 4, 1976, that is assigned to the same assignee as this invention.

FIGS. 2 and 3 of the drawing illustrate in respective top and side section views one example of a two-piece interface electrical connector assembly 10 suitable for use with the system of this invention for providing an electrical connection between a vehicle body 4 and a vehicle sliding door 6 while sliding door 6 is closed. A support member 9 of an insulating material rigidly supports three aligned bayonet type connector pins 11, 12 and 13, best illustrated in FIG. 3, and is suitably rigidly mounted upon the edge of sliding door 6 that, when closed, is adjacent the sliding door pillar portion 7 of vehicle body 4. Another support member 14 of an insulating material rigidly supports three aligned spring contact members 11A, 12A and 13A, best illustrated in FIG. 3. Support member 14 is suitably rigidly mounted upon the sliding door pillar portion 7 of vehicle body 4 in such a manner and location that each of spring contact members 11A, 12A and 13A is frictionally engageable in electrical circuit completing contact with a corresponding bayonet type connector pin 11, 12 and 13, respectively, when sliding door 6 is closed. Upon the operation of sliding door 6 open, the electrical connection between the sliding door and vehicle body is interrupted as the bayonet-type connector pins are operated out of engagement with the corresponding spring contact members.

In FIG. 1 of the drawing, the left front door, the right front door and the sliding door power door lock mechanism electrically energizable actuating devices are illustrated as respective conventional permanent magnet type direct current electric motors 16, 17 and 18. To selectively lock and unlock the doors, respective left and right front door control switches of the spring return to neutral single pole-double throw type are provided and are referenced by the numerals 20 and 30. Switches 20 and 30 have respective spring return to neutral movable contacts 21 and 31, respective "Lock" position stationary contacts 22 and 32 and respective "Unlock" position stationary contacts 23 and 33. Spring return to neutral single pole-double throw type door lock control switches as schematically illustrated in the drawing are well known in the automotive art. An electrical power switching relay 35 is illustrated in the drawing as being of the type having two operating coils 36 and 37, a movable contact 38 normally closed to stationary contact 39 and electrically operable into electrical circuit completing engagement with stationary contact 40 upon the energization of operating coil 36 and another movable contact 41 normally closed to stationary contact 42 and electrically operable into electrical circuit completing engagement with stationary contact 43 upon the energization of operating coil 37. Stationary contacts 39 and 42 are connected to point of reference or ground potential 5 and stationary contacts 40 and 43 are connected through leads 45 and 46 to the positive polarity output terminal of a conventional storage battery 3 that supplies the required operating potential. It is to be specifically understood, however, that two relays having similar switching capabilities may be employed without departing from the spirit of the invention.

The portion of the circuit of FIG. 1 that comprises the vehicle sliding door power door lock mechanism actuating device control system of this invention is set forth in schematic form within dashed rectangle 15. This circuitry includes a sliding door power switching relay 25 having a movable contact 26 that is normally closed to stationary contact 27 connected to point of reference or ground potential 5 and is electrically operable into electrical circuit completing engagement with a stationary contact 28 upon the energization of operating coil 29. Diode 24 is a free-wheeling diode connecting across operating coil 29 for the purpose of suppressing transient potentials that may be produced upon the interruption of the energizing circuit of operating coil 29.

To lock all of the vehicle doors while the sliding door is closed, either movable contact 21 of control switch 20 or movable contact 31 of control switch 30 may be operated to the "Lock"position. Assuming for purposes of this specification that movable contact 21 of control switch 20 is operated into electrical circuit closing engagement with stationary contact 22 of the "Lock" position, an energizing circuit is established for operating coil 37 of front door power switching relay 35. This circuit may be traced from the positive polarity output terminal of battery 3, through leads 46 and 47, movable contact 21 and stationary contact 22 of control switch 20, leads 48 and 49, operating coil 37 of front door power switching relay 35 and point of reference or ground potential 5 to the negative polarity output terminal of battery 3. Upon the energization of operating coil 37, movable contact 41 is operated into electrical circuit closing engagement with stationary contact 43 to complete an electrical energizing circuit for respective left and right front door motors 16 and 17 in parallel. This circuit may be traced from the positive polarity output terminal of battery 3, through leads 46 and 45, stationary contact 43 and movable contact 41 of front door power switching relay 35, leads 50 and 51, left and right front door motors 16 and 17 in parallel, leads 52 and 53, movable contact 38 and stationary contact 39 of front door power switching relay 35 and point of reference or ground potential 5 to the negative polarity output terminal of battery 3. Upon the completion of this energizing circuit, the armatures of both left and right front door motors 16 and 17 revolve in the direction to actuate the left and right front door power door lock mechanisms to the "Lock" condition. It may be noted that sliding door motor 18 is not immediately energized upon the operation of control switch 20 as each side of the armature thereof is connected to point of reference or ground potential 5 through lead 52 and through lead 54 and movable contact 26 and stationary contact 27 of sliding door power switching relay 25.

Upon the operation of movable contact 21 of control switch 20 into electrical circuit closing engagement with stationary contact 22, a logic 1 signal appears upon junction 55 between diode 56 and resistor 57. This logic 1 signal is applied through lead 58 to the "b" input terminal of conventional OR gate 60 and through lead 62 to the J input terminal of conventional J-K flip-flop circuit 65. In response to the logic 1 signal applied to the "b" input terminal thereof, OR gate 60 produces a logic 1 output signal that is applied to the "b" input terminal of conventional OR gate 66 which, in response thereto, produces a logic 1 output signal that is applied to the +TR input terminal of conventional monostable multivibrator timer circuit 70. As is well known in the art, the monostable multivibrator circuit normally operates in a stable state and may be switched in response to an electrical signal to an alternate state in which it remains for a period of time as determined by the associated R-C timing network, either internal or external. After timing out, the device spontaneously returns to the stable state. In response to the logic 1 output signal of OR gate 66, monostable multivibrator timer circuit 70 is triggered to the alternate state in which a logic 0 signal is present upon the $\overline{Q}$ output terminal and remains in the alternate state for a predetermined period of time as determined by the associated R-C timing circuit network. At the termination of the delay time as determined by the R-C timing circuit network, this device spontaneously reverts to the original or stable state in which a logic 1 signal appears upon the $\overline{Q}$ output terminal. This positive-going logic 1 output signal is applied as a clock signal to the CK clock input terminal of J-K flip-flop circuit 65.

The J-K flip-flop circuit is a logic memory element well known in the art that yields a predictable output for every possible combination of pulse inputs. Depending upon the type J-K flip-flop considered, upon the positive or the negative transition of each clock pulse applied to the CK clock pulse input terminal thereof: (1) with no signal applied to either the J or K input terminals, the J-K flip-flop circuit remains in its pre-existing state (2) with a logic 1 signal applied to the J input terminal and a logic 0 signal applied to the K input terminal, it is triggered to the "Set" state in which a logic 1 signal appears upon the Q output terminal and a logic 0 signal appears upon the $\overline{Q}$ output terminal (3) with a logic 0 signal applied to the J input terminal and a logic 1 signal applied to the K input terminal, it is triggered to the "Reset" state in which a logic 0 appears upon the Q output terminal and a logic 1 signal appears upon the $\overline{Q}$ output terminal, and (4) with logic 1 signals simultaneously applied to both the J and K input terminals, the state of the component reverses from the state that previously existed the application of the clock pulse. As J-K flip-flop circuit 65 changes state in synchronism with the positive-going transition of the clock pulse, upon the appearance of the positive-going logic 1 clock pulse upon the $\overline{Q}$ output terminal of monostable multivibrator timer circuit 70, J-K flip-flop circuit 65 is triggered to the "Set" state in which a logic 1 signal is present upon the Q output terminal thereof and a logic 0 "Lock" command signal appears upon the $\overline{Q}$ output terminal. The logic 0 "Lock" command signal is stored by J-K flip-flop circuit 65 and is applied to the "b" input terminal of conventional OR gate 71. J-K flip-flop circuit 65, therefore, is responsive to the operation of either control switch 20 or control switch 30 to the "Lock" position for producing and storing a "Lock" command signal. As the vehicle sliding door is closed, junction 72 is connected to point of reference or ground potential 5 through lead 73 and spring contact member 13A and bayonet type connector pin 13 of the interface electrical connector assembly 10. Consequently, an enabling logic 0 signal is present upon junction 72 and is applied to the "a" input terminal of OR gate 71. In response to a logic 0 signal upon both input terminals thereof, OR gate 71 produces a logic 0 output signal that is applied to the −TR input terminal of monostable multivrator timer circuit 75 to trigger this device to its alternate state in which a logic 1 signal is present upon the Q output terminal and a logic 0 signal is present upon the $\overline{Q}$ output terminal thereof. The logic 1 signal present upon the Q output terminal of monostable multivibrator timer circuit 75 is applied through leads 83 and 84 to the "a" input terminal of conventional OR gate 66 and to the "b" input terminal of conventional OR gate 85 and through lead 83 and resistor 76 to the base electrode of NPN switching transistor 80 and the logic 0 signal present upon the $\overline{Q}$ output terminal is applied through lead 86 to the −TR input terminal of monostable multivibrator timer circuit 70.

The logic 1 output signal applied through lead 83 and resistor 76 to the base electrode of NPN switching transistor 80 supplies base-emitter drive current to NPN switching transistor 80 in the proper polarity relationship to trigger this device conductive through the collector-emitter electrodes thereof. Upon the conduction of NPN transistor 80, an energizing circuit is completed for operating coil 29 of sliding door power switching relay 25 which may be traced from the positive polarity output terminal of battery 3, through leads 46, 81 and 82, operating coil 29, the collector-emitter electrodes of conducting NPN transistor 80 and point of reference or ground potential 5 to the negative polarity output terminal of battery 3. If desirable, or should the energizing current for operating coil 29 of relay 25 so dictate, an NPN transistor Darlington pair may be substituted for NPN transistor 80. Upon the energization of operating coil 29, movable contact 26 thereof is operated into electrical circuit closing engagement with stationary contact 28 to complete an energizing circuit for sliding door motor 18 which may be traced from the positive polarity output terminal of battery 3, through leads 46, 81 and 82, stationary contact 28 and movable contact 26 of sliding door power switching relay 25, lead 54, spring contact 12A and bayonet type connector pin 12 of interface electrical connector assembly 10, motor 18, bayonet type connector pin 11 and spring contact 11A of interface electrical connector assembly 10, leads 52 and 53, movable contact 38 and stationary contact 39 of front door power switching relay 35 and point of reference or ground potential 5 to the negative polarity output terminal of battery 3. Upon the closure of this energizing circuit, the armature of sliding door motor 18 revolves in the direction to actuate the sliding door power door lock mechanism to the "Lock" condition. The timing circuit associated with monostable multivibrator timer circuit 75 is designed to provide a predetermined period of delay at the conclusion of which this device spontaneously returns to its original stable state in which a logic 0 signal is present upon the Q output terminal and a logic 1 signal is present upon the $\overline{Q}$ output terminal. In the actual embodiment, this delay period was of the order of 2 seconds which provides ample time for the sliding door to be locked.

In the meantime, each of conventional OR gates 66 and 85 produces a logic 1 output signal in response to the logic 1 signal applied to the respective "a" and "b" input terminals thereof. The logic 1 signal produced by OR gate 85 is applied to the K input terminal of J-K flip-flop circuit 65 and the logic 1 signal produced by OR gate 66 is applied to the +TR input terminal of monostable multivibrator timer circuit 70 to trigger this device to the alternate state in which a logic 0 signal is present upon the $\overline{Q}$ output terminal thereof. The logic 0 signal applied to the −TR input terminal of monostable multivibrator timer circuit 70 at this same time insures that this device is triggered to the alternate state. At the termination of the delay time previously brought out, this device spontaneously reverts to the original or stable state in which a logic 1 clock signal appears upon the $\overline{Q}$ output terminal that is applied to the CK clock input terminal of J-K flip-flop circuit 65. Upon the appearance of the positive-going logic 1 clock pulse upon the $\overline{Q}$ output terminal of monostable multivibrator timer circuit 70 and with a logic 1 signal present upon the K input terminal thereof, J-K flip-flop circuit 85 is triggered to the "Reset" state in which a logic 1 signal appears upon the $\overline{Q}$ output terminal. Therefore, the combination of OR gate 85, OR gate 66 and monostable multivibrator timer circuit 70 is responsive to the logic 1 output signal upon the Q output terminal of monostable multivibrator timer circuit 75 for effecting the removal of the logic 0 "Lock" command signal from storage in J-K flip-flop circuit 65.

To unlock all of the vehicle doors while the sliding door is closed, either movable contact 21 of control switch 20 or movable contact 31 of control switch 30 may be operated to the "Unlock" position. Assuming for purposes of this specification that movable contact 31 of control switch 30 is operated into electrical circuit closing engagement with stationary contact 33 of the "Unlock" position, an energizing circuit is established for operating coil 36 of front door power switching relay 35. This circuit may be traced from the positive polarity output terminal of battery 3, through leads 46 and 47, movable contact 31 and stationary contact 33 of control switch 30, leads 88 and 89, operating coil 36 of front door power switching relay 35 and point of reference or ground potential 5 to the negative polarity output terminal of battery 3. Upon the energization of operating coil 36, movable contact 38 is operated into electrical circuit closing engagement with stationary contact 40 to complete an electrical energizing circuit for respective left and right front door motors 16 and 17 in parallel and for sliding door motor 18. The energizing circuit for left and right front door motors 16 and 17 may be traced from the positive polarity output terminal of battery 3, through leads 46 and 45, stationary contact 40 and movable contact 38 of front door power switching relay 35, leads 53 and 52, left and right front door motors 16 and 17 in parallel, lead 50, movable contact 41 and stationary contact 42 of front door power switching relay 35 and point of reference or ground potential 5 to the negative polarity output terminal of battery 3. Upon the completion of this energizing circuit, the armatures of both left and right front door motors 16 and 17 revolve in the direction to actuate the left and right front door power door lock mechanisms to the "Unlock" condition. The energizing circuit for sliding door motor 18 may be traced from the positive polarity output terminal of battery 3, through leads 46 and 45, stationary contact 40 and movable contact 38 of front door relay 35, leads 53 and 52, spring contact member 11A and bayonet type connector 11 of interface electrical connector assembly 10, motor 18, bayonet type connector 12 and spring contact member 12A of interface electrical connector assembly 10, lead 54, movable contact 26 and stationary contact 27 of relay 25 and point of reference or ground potential 5 to the negative polarity output terminal of battery 3. Upon the closure of this energizing circuit, the armature of motor 18 revolves in the direction to actuate the sliding door power door lock mechanism to the "Unlock" condition.

Upon the operation of movable contact 31 of control switch 30 into electrical circuit closing engagement with stationary contact 33, a logic 1 signal appears upon junction 90 between diode 91 and resistor 92. This logic 1 signal is applied through lead 93 to the "a" input terminal of conventional OR gate 60 and through lead 94 to the "a" input terminal of conventional OR gate 85. In response to the logic 1 signals applied to the respective "a" input terminals thereof, OR gates 60 and 85 each produces a logic 1 output signal. The logic 1 output signal of OR gate 60 is applied to the "b" input terminal of conventional OR gate 66 and the logic 1 output signal of OR gate 85 is applied to the K input terminal of J-K flip-flop circuit 65. In response to the logic 1 signal applied to the "a" input terminal thereof, OR gate 66 produces a logic 1 output signal that is applied to the +TR input terminal of conventional monostable multivibrator timer circuit 70. In response to this logic 1 signal, monostable multivibrator timer circuit 70 is triggered to the alternate state in which a logic 0 signal is present upon the $\overline{Q}$ output terminal and remains in the alternate state for a predetermined period of time as determined by the associated R-C timing circuit network. At the termination of the delay time as determined by the R-C timing circuit network, this device spontaneously reverts to the original or stable state in which a logic 1 signal appears upon the $\overline{Q}$ output terminal. This positive-going logic 1 outut signal is applied as a clock signal to the CK clock input terminal of J-K flip-flop circuit 65. As J-K flip-flop circuit 65 changes state in synchronism with the positive-going transition of the clock pulse, upon the appearance of the positive-going logic 1 clock pulse upon the $\overline{Q}$ output terminal of monostable multivibrator timer circuit 70, J-K flip-flop circuit 65 is triggered to the "Reset" state in which a logic 0 signal is present upon the Q output terminal thereof and a logic 1 signal is present upon the $\overline{Q}$ output terminal that is applied to the "b" input terminal of OR gate 71. In response to the logic 1 signal upon the "b" input terminal thereof, OR gate 71 produces a logic 1 output signal that is applied to the −TR input terminal of monostable multivibrator timer circuit 75. This logic 1 signal is ineffective to trigger this device to its alternate state in which a logic 1 signal is present upon the Q output terminal and a logic 0 signal is present upon the $\overline{Q}$ output terminal thereof. Consequently, NPN switching transistor 80 is not triggered conductive to energize operating coil 29 of sliding door power switching relay 25. With operating coil 29 not energized, the previously described ground connection for sliding door motor 18 through movable contact 26 and stationary contact 27 is maintained.

From the foregoing description, it is apparent that, while the sliding door is closed, the power door lock circuit operates in a conventional manner.

To lock all of the vehicle doors while the sliding door is open, either movable contact 21 of control switch 20 or movable contact 31 of control switch 30 may be operated to the "Lock" position. Assuming for purposes of this specification that movable contact 21 of control switch 20 is operated into electrical circuit closing engagement with stationary contact 22 of the "Lock" position, an energizing circuit is established for operating coil 37 of front door power switching relay 35. This circuit may be traced from the positive polarity output terminal of battery 3, through leads 46 and 47, movable contact 21 and stationary contact 22 of control switch 20, leads 48 and 49, operating coil 37 of front door power switching relay 35 and point of reference or ground potential 5 to the negative polarity output terminal of battery 3. Upon the energization of operating coil 37, movable contact 41 is operated into electrical circuit closing engagement with stationary contact 43 to complete an electrical energizing circuit for respective left and right front door motors 16 and 17 in parallel. This circuit may be traced from the positive polarity output terminal of battery 3, through leads 46 and 45, stationary contact 43 and movable contact 41 of front door power switching relay 35, leads 50 and 51, left and right front door motors 16 and 17 in parallel, leads 52 and 53, movable contact 38 and stationary contact 39 of front door power switching relay 35 and point of reference or ground potential 5 to the negative polarity output terminal of battery 3. Upon the completion of this energizing circuit, the armatures of both left and right front door motors 16 and 17 revolve in the direction to actuate the left and right front door power door lock mechanisms to the "Lock" condition. It may be noted that sliding door motor 18 is not energized at this time as each side of the armature thereof is disconnected from the vehicle wiring harness by interface electrical connector assembly 10.

Upon the operation of movable contact 21 of control switch 20 into electrical circuit closing engagement with stationary contact 22, a logic 1 signal appears upon junction 55 between diode 56 and resistor 57. This logic 1 signal is applied through lead 58 to the "b" input terminal of conventional OR gate 60 and through lead 62 to the J input terminal of conventional J-K flip-flop circuit 65. In response to the logic 1 signal applied to the "b" input terminal thereof, OR gate 60 produces a logic 1 output signal that is applied to the "b" input terminal of conventional OR gate 66 which, in response thereto, produces a logic 1 output signal that is applied to the +TR input terminal of conventional monostable multivibrator timer circuit 70. In response to this logic 1 signal, monostable multivibrator timer circuit 70 is triggered to the alternate state in which a logic 0 signal is present upon the $\overline{Q}$ output terminal and remains in the alternate state for a predetermined period of time as determined by the associated R-C timing circuit network. At the termination of the delay time as determined by the R-C timing circuit network, this device spontaneously reverts to the original or stable state in which a logic 1 signal appears upon the $\overline{Q}$ output terminal. This positive-going logic 1 output signal is applied as a clock signal to the CK clock input terminal of J-K flip-flop circuit 65. As J-K flip-flop circuit 65 changes state in synchronism with the positive-going transition of the clock pulse, upon the appearance of the positive-going logic 1 clock pulse upon the $\overline{Q}$ output terminal of monostable multivibrator timer circuit 70, J-K flip-flop circuit 65 is triggered to the "Set" in which a logic 1 signal is present upon the Q output terminal thereof and a logic 0 "Lock" command signal appears upon the $\overline{Q}$ output terminal. The logic 0 "Lock" command signal is stored by J-K flip-flop circuit 65 and is applied to the "b" input terminal of conventional OR gate 71. J-K flip-flop circuit 65, therefore, is responsive to the operation of control switch 20 to the "Lock" position for producing and storing a "Lock" command signal. As the vehicle sliding door is open, junction 72 is connected to the positive polarity ouput terminal of battery 3 through resistor 95 and leads 96, 81 and 46 to place a logic 1 signal upon this junction that is applied to the "a" input terminal of OR gate 71. In response to the logic 1 signal upon the "a" input terminal thereof, OR gate 71 produces a logic 1 output signal that is applied to the −TR input terminal of monostable multivibrator timer circuit 75. This logic 1 signal is ineffective to trigger this device to its alternate state in which a logic 1 signal is present upon the Q output terminal and a logic 0 signal is present upon the $\overline{Q}$ output terminal thereof. Consequently, the circuit remains in this state with a logic 0 "Lock" command signal present in storage upon the $\overline{Q}$ output terminal of J-K flip-flop circuit 65 and with no logic 0 enabling signal present upon junction 72. Upon the subsequent closure of the vehicle sliding door, junction 72 is connected to point of reference or ground potential 5 through lead 73 and spring contact member 13A and bayonet type connector pin 13 of the interface electrical connector assembly 10. Consequently, upon the closure of the sliding door, the enabling logic 0 signal appears upon junction 72 and is applied to the "a" input terminal of OR gate 71. In response to the respective logic 0 "Lock" command and enabling signals upon the "b" and "a" input terminals thereof, OR gate 71 produces a logic 0 output signal that is applied to the −TR input terminal of monostable multivibrator timer circuit 75 to trigger this device to its alternate state in which a logic 1 signal is present upon the Q output terminal and a logic 0 signal is present upon the $\overline{Q}$ output terminal thereof. The logic 1 signal present upon the Q output terminal of monostable multivibrator timer circuit 75 is applied through leads 83 and 84 to the "a" input terminal of conventional OR gate 66 and to the "b" input terminal of conventional OR gate 85 and through lead 83 and resistor 76 to the base electrode of NPN switching transistor 80 and the logic 0 signal present upon the $\overline{Q}$ output terminal is applied through lead 86 to the −TR input terminal of monostable multivibator timer circuit 70.

The logic 1 output signal applied through lead 83 and resistor 76 to the base electrode of NPN switching transistor 80 supplies base-emitter drive current to NPN switching transistor 80 in the proper polarity relationship to trigger this device conductive through the collector-emitter electrodes thereof. Upon the conduction of NPN transistor 80, an energizing circuit is completed for operating coil 29 of sliding door power switching relay 25 which may be traced from the positive polarity output terminal of battery 3, through leads 46, 81 and 82, operating coil 29, the collector-emitter electrodes of conducting NPN transistor 80 and point of reference or ground potential 5 to the negative polarity output terminal of battery 3. If desirable or should the energizing current for operating coil 29 of relay 25 so dictate, an NPN transistor Darlington pair may be substituted for NPN transistor 80. Upon the energization of operating coil 29, movable contact 26 thereof is operated into electrical circuit closing engagement with stationary contact 28 to complete an energizing circuit for sliding door motor 18 which may be traced from the positive polarity output terminal of battery 3, through leads 46, 81 and 82, stationary contact 28 and movable contact 26 of sliding door power switching relay 25, lead 54, spring contact 12A and bayonet type connector pin 12 of interface electrical connector assembly 10, motor 18, bayonet type connector pin 11 and spring contact 11A of interface electrical connector assembly 10, leads 52 and 53, movable contact 38 and stationary contact 39 of front door power switching relay 35 and point of reference or ground potential 5 to the negative polarity output terminal of battery 3. Upon the closure of this energizing circuit, the armature of sliding door motor 18 revolves in the direction to actuate the sliding door power door lock mechanism to the "Lock" condition. The timing circuit associated with monostable multivibrator timer circuit 75 is designed to provide a predetermined period of delay at the conclusion of which this device spontaneously returns to its original stable state in which a logic 0 signal is present upon the Q output terminal and a logic 1 signal is present upon the $\overline{Q}$ output terminal. In the actual embodiment, this delay period was of the order of 2 seconds which provides ample time for the sliding door to be locked.

In the meantime, each of conventional OR gates 66 and 85 produces a logic 1 output signal in response to the logic 1 signal applied to the respective "a" and "b" input terminals thereof. The logic 1 signal produced by OR gate 85 is applied to the K input terminal of J-K flip-flop circuit 65 and the logic 1 signal produced by OR gate 66 is applied to the +TR input terminal of monostable multivibrator timer circuit 70 to trigger this device to the alternate state in which a logic 0 signal is present upon the $\overline{Q}$ output terminal thereof. The logic 0 signal applied to the $-TR$ input terminal of monostable multivibrator timer circuit 70 at this same time insures that this device is triggered to the alternate state. At the termination of the delay time previously brought out, this device spontaneously reverts to the original or stable state in which a logic 1 clock signal appears upon the $\overline{Q}$ output terminal that is applied to the CK clock input terminal of J-K flip-flop circuit 65. Upon the appearance of the positive-going logic 1 clock pulse upon the $\overline{Q}$ output terminal of monostable multivibrator timer circuit 70 and with a logic 1 signal present upon the K input terminal thereof, J-K flip-flop circuit 85 is triggered to the "Reset" state in which a logic 1 signal appears upon the $\overline{Q}$ output terminal. Therefore, the combination of OR gate 85, OR gate 66 and monostable multivibrator timer circuit 70 is responsive to the logic 1 output signal upon the Q output terminal of monostable multivibrator timer circuit 75 for effecting the removal of the logic 0 "Lock" command signal from storage in J-K flip-flop circuit 65.

From the foregoing description, it is apparent that the vehicle sliding door power lock mechanism actuating device control circuit of this invention may be used with power door lock mechanisms of the type actuated by an electrically energizable actuating device to "Lock" and "Unlock" conditions in response to respective "Lock" and "Unlock" command signals and by reason of a memory feature, is operative to effect the electrical energization of the lock mechanism actuating device in a direction to actuate the lock mechanism to the "Lock" condition upon each closure of the sliding door subsequent to an occurrence of a "Lock" command signal while the door is open.

While a preferred embodiment of the present invention has been shown and described, it will be obvious to those skilled in the art that various modifications and substitutions may be made without departing from the spirit of the invention which is to be limited only within the scope of the appended claims.

The embodiments of the invention in which an exclusive property or privilege is claimed are defined as follows:

1. A vehicle sliding door power door lock mechanism actuating device control system having a memory feature for use with power door lock mechanisms of the type actuated by an electrically energizable actuating device to "Lock" and "Unlock" conditions in response to respective "Lock" and "Unlock" command signals and operative to effect the electrical energization of the lock mechanism actuating device in a direction to actuate the lock mechanism to the "Lock" condition upon each closure of the sliding door subsequent to an occurrence of a "Lock" command signal while the door is open, comprising:

means responsive to the operation of a spring return to neutral type door lock control switch to the "Lock" position for producing and storing a "Lock" command logic signal;

means responsive to the closure of said vehicle sliding door for producing an enabling logic signal;

means responsive to said "Lock" command and enabling logic signals for producing an output electrical signal;

first means responsive to said output electrical signal for effecting the electrical energization of said lock mechanism actuating device in a direction to actuate said lock mechanism to said "Lock" condition, and second means responsive to said output electrical signal for effecting the removal of said "Lock" command logic signal from storage.

2. A vehicle sliding door power lock mechanism actuating device control circuit having a memory feature for use with power door lock mechanisms of the type actuated by an electrically energizable actuating device to "Lock" and "Unlock" conditions in response to respective "Lock" and "Unlock" command signals and operative to effect the electrical energization of the lock mechanism actuating device in a direction to actuate the lock mechanism to the "Lock" condition upon each closure of the sliding door subsequent to an occurrence of a "Lock" command signal while the door is open, comprising:

means, including a first timer means, responsive to the operation of a spring return to neutral type door lock switch to the "Lock" position for producing and storing a "Lock" command logic signal;

means responsive to the closure of said vehicle sliding door for producing an enabling logic signal;

means, including a second timer means, responsive to said "Lock" command and enabling logic signals for producing an output electrical signal;

first means responsive to said output electrical signal for effecting the electrical energization of said lock mechanism actuating device in a direction to actuate said lock mechanism to said "Lock" condition; and second means, including said first timer means, responsive to said output electrical signal for effecting the removal of said "Lock" command logic signal from storage.

3. A vehicle sliding door power lock mechanism actuating device control circuit having a memory feature for use with power door lock mechanisms of the type actuated by an electrically energizable actuating device to "Lock" and "Unlock" conditions in response to respective "Lock" and "Unlock" command signals and operative to effect the electrical energization of the lock mechanism actuating device in a direction to actuate the lock mechanism to the "Lock" condition upon each closure of the sliding door subsequent to an occurrence of a "Lock" command signal while the door is open, comprising:

means responsive to the operation of a spring return to neutral type door lock switch to the "Lock" position for producing a logic signal;

means including timer circuit means responsive to said logic signal for producing and storing a "Lock" command logic signal;

means responsive to the closure of said vehicle sliding door for producing an enabling logic signal;

means responsive to said "Lock" command and enabling logic signals for producing an output electrical signal;

first means responsive to said output electrical signal for effecting the electrical energization of said lock mechanism actuating device in a direction to actuate said lock mechanism to said "Lock" condition; and second means including said timer circuit means responsive to said output electrical signal for effecting the removal of said "Lock" command logic signal from storage.

4. A vehicle sliding door power lock mechanism actuating device control circuit having a memory feature for use with power door lock mechanisms of the type actuated by an electrically energizable actuating device to "Lock" and "Unlock" conditions in response to respective "Lock" and "Unlock" command signals and operative to effect the electrical energization of the lock mechanism actuating device in a direction to actuate the lock mechanism to the "Lock" condition upon each closure of the sliding door subsequent to an occurrence of a "Lock" command signal while the door is open, comprising:

a J-K flip-flop circuit having J and K input terminals and Q and $\overline{Q}$ output terminals;

means responsive to the operation of a spring return to neutral type door lock switch to the "Lock" position for producing a logic 1 signal and for applying said logic 1 signal to said J input terminal of said J-K flip-flop circuit;

means including timer circuit means for effecting the transfer of said logic 1 signal applied to said J input terminal of said J-K flip-flop circuit to said Q output terminal thereof whereby a logic 0 "Lock" command signal is present upon the J-K flip-flop circuit $\overline{Q}$ output terminal;

means responsive to the closure of said vehicle sliding door for producing an enabling logic signal;

means responsive to said "Lock" command and enabling logic signals for producing an output electrical signal;

first means responsive to said output electrical signal for effecting the electrical energization of said lock mechanism actuating device in a direction to actuate said lock mechanism to said "Lock" condition; and second means including said timer circuit means responsive to said output electrical signal for effecting the removal of said logic 0 "Lock" command signal from said $\overline{Q}$ output terminal of said J-K flip-flop circuit.

* * * * *